US008758075B2

(12) United States Patent
Rubinfeld

(10) Patent No.: US 8,758,075 B2
(45) Date of Patent: Jun. 24, 2014

(54) PLUSH TOY SOAP AND SPONGE HOLDER

(76) Inventor: Allan D. Rubinfeld, Miami, FL (US)

( * ) Notice: Subject to any disclaimer, the term of this patent is extended or adjusted under 35 U.S.C. 154(b) by 203 days.

(21) Appl. No.: 13/306,428

(22) Filed: Nov. 29, 2011

(65) Prior Publication Data

US 2013/0137338 A1 May 30, 2013

(51) Int. Cl.
*A47K 7/03* (2006.01)

(52) U.S. Cl.
USPC ..... 446/73; 446/75

(58) Field of Classification Search
USPC ..... 446/72, 73, 75, 76
See application file for complete search history.

(56) References Cited

U.S. PATENT DOCUMENTS

| | | | | |
|---|---|---|---|---|
| 1,390,667 | A * | 9/1921 | Bonesthll | 426/104 |
| 1,442,761 | A * | 1/1923 | Beach | 446/372 |
| 2,035,014 | A * | 3/1936 | Schaefer | 401/201 |
| 4,154,542 | A * | 5/1979 | Rasmason | 401/7 |
| 5,238,305 | A * | 8/1993 | Feller | 383/22 |
| 5,326,300 | A * | 7/1994 | Sonders | 446/74 |
| 5,462,378 | A * | 10/1995 | Webb | 401/201 |
| 5,857,794 | A * | 1/1999 | Chien | 401/201 |
| 6,227,742 | B1 * | 5/2001 | Corn et al. | 401/201 |
| 6,312,307 | B1 * | 11/2001 | Dean, II | 446/297 |
| D510,195 | S * | 10/2005 | Adams | D6/608 |
| 2002/0088729 | A1 * | 7/2002 | Urbanski | 206/373 |
| 2002/0100120 | A1 * | 8/2002 | Hsu | 5/413 R |
| 2002/0127044 | A1 * | 9/2002 | Sorrell | 401/201 |
| 2003/0077978 | A1 * | 4/2003 | Beige | 446/369 |
| 2004/0113583 | A1 * | 6/2004 | Konigbauer | 318/778 |
| 2007/0065224 | A1 * | 3/2007 | Shaw | 401/201 |
| 2009/0205102 | A1 * | 8/2009 | Anderson | 2/85 |
| 2010/0003887 | A1 * | 1/2010 | Greene | 446/75 |

* cited by examiner

*Primary Examiner* — Vishu K. Mendiratta
(74) *Attorney, Agent, or Firm* — Allen, Dyer, Doppelt, Milbrath & Gilchrist, P.A.

(57) ABSTRACT

A fabric bathing toy in the shape of a figure appealing to children that has a mesh pocket for holding soap. Preferably, the figure resembles an animal or insect. The toy includes a fastening component to contain the soap in the mesh pocket. The toy includes a cavity in the body of the toy for holding a sponge. The toy includes a fastening component to contain the sponge in the cavity. A suction cup is attached to the toy so that the toy adheres and hangs from a surface to promote drying.

8 Claims, 9 Drawing Sheets

PLUSH TOY SOAP AND SPONGE HOLDER

FIELD OF THE INVENTION

The present invention relates to the field of bathing implements and, more particularly, to a plush toy and soap holding device.

BACKGROUND OF THE INVENTION

Children have a notorious propensity for making themselves dirty, and this is often accompanied by an unfortunate predisposition for avoiding bathing. It is also often a difficult task to convince a child to bathe, and sometimes an outright battle. For a child to bathe on their own accord is often an even more difficult, if not an insurmountable, proposition.

Fortunately, most children have highly active imaginations and immensely enjoy playtime activities. An age-old mechanism to coax a child into enduring bath-time is through the use of bath toys.

Though bath toys may convince a child to enter a bath, bath toys provide little, if any, benefit for actually cleaning the child. To have a child remain placidly in a bath tub is only half of the equation. The other significant hurdle is the actual utilization of soap to clean a child.

With the foregoing in mind, a primary object of the present invention is to provide a bathing toy that is enjoyable for a child to use for play, yet is also a means of providing soap for a bathing child in an appealing and effective way.

Another object of the invention is to promote enjoyment of bathing by children through play, thereby minimizing resistance to bathing and fostering good personal hygiene habits by children.

Another object of the invention is to provide an incentive for children to bathe with soap so that good personal hygiene habits are instilled into children while young with the goal that these children will bathe with soap on their own accord when older or unsupervised.

SUMMARY OF THE INVENTION

In view of the foregoing background, it is therefore an object of the present invention to provide a soft and safe bathing toy that is enjoyable for a child to use for play, yet is also a means of providing soap and a sponge to a child in an appealing and effective way. The bath toy contemplated by this invention comprises a fabric outer sheath having a first side, a second side, and a hollow inner cavity between the first side and the second side, formed to substantially define the shape of the toy. Additionally, a first mesh panel is attached to the first side of the outer sheath having a non-attached edge that defines a first opening, thereby forming a first pocket to hold soap. A first fastener closes the first opening of the first pocket for the purposes of securing the soap. The first fastener is at least one of a snap, hook & loop fastener, button, zipper, buckle, and hook & eye fastener.

The fabric for the outer sheath is selected from the group consisting of cloth, leather, suede, plush, fustian, velvet, mohair, worsted yarn, silk, cotton, polyester, terry cloth, lycra, neoprene, fleece, and combinations thereof.

In another embodiment, the invention comprises a second opening on the second side of the outer sheath that provides access to the hollow inner cavity of the outer sheath. This forms a compartment capable of encasing a sponge. A second fastener closes the second opening of the outer sheath for the purpose of securing the sponge. The second fastener is at least one of a snap, hook & loop fastener, drawstring, button, zipper, buckle, and hook & eye fastener.

In one embodiment, a suction cup, having a suction side and a mounting side, is attached by the mounting side to the second side of the outer sheath so the suction side faces outwards from the outer sheath, allowing the toy to be suctionably held to a surface capable of engaging a suction cup.

In one embodiment, a second mesh panel is attached to the second side of the outer sheath forming a second pocket to hold a sponge, and a third fastener closes the second pocket for the purpose of securing the sponge. The third fastener is at least one of a snap, hook & loop fastener, drawstring, button, zipper, buckle, and hook & eye fastener.

In one embodiment, the first fastener is a drawstring having a first end, a second end, and a middle portion between the first and second ends. The drawstring is threaded through the first mesh panel so that the middle portion of the drawstring is proximate the non-attached edge. At least one first hole in the first side of the outer sheath accommodates passage by the first and second ends of the drawstring through the first hole, while at least one second hole in the second side of the outer sheath accommodates passage by the first and second ends of the drawstring through the second hole so that the drawstring may be tightened, thereby drawing the first pocket against the first side of the outer sheath.

In some embodiments, the outer sheath is configured to resemble an animal. In one embodiment, a body member is substantially formed by the outer sheath, a head member attached to the body member, and at least one limb attached to the body member. The animal is one of an aardvark, alligator, American bison, buffalo, ant, anteater, antelope, ape, armadillo, ass/donkey, baboon, badger, barracuda, bat, bear, beaver, bee, bison, boar, buffalo, bunny, bush baby, butterfly, camel, caribou, cat, caterpillar, chamois, cheetah, chicken, chimpanzee, chinchilla, cobra, cockroach, cormorant, cow, coyote, crab, crane, crocodile, crow, deer, dog, dogfish, dolphin, donkey, dove, dragonfly, duck, dugong, eagle, echidna, eel, eland, elephant, elephant seal, elk, falcon, ferret, finch, fish, fly, fox, frog, gaur, gazelle, gerbil, giant panda, giraffe, gnu, goat, goose, gorilla, silverback, guanaco guinea fowl, guinea pig, gull, hamster, hare, hawk, hedgehog, heron, hippopotamus, hornet, horse, human, hyena, iguana, jackal, jaguar, jellyfish, kangaroo, koala, komodo dragon, kouprey, kudu, lark, lemur, leopard, lion, llama, lobster, locust, loris, louse, lyrebird, magpie, mallard, manatee, meerkat, mink, mole, monkey, moose, mouse, mosquito, mule, narwhal, newt, nightingale, okapi, oryx, ostrich, otter, owl, ox, oyster, panther, partridge, peafowl, pelican, penguin, pig, pigeon, platypus, pony, porcupine, quelea, rabbit, raccoon, rail, ram, rat, raven, red deer, red panda, reindeer, rhinoceros, salamander, sea lion, seahorse, seal, seastar, shark, sheep, shrew, skunk, snail, snake, spider, squid, squirrel, stinkbug, swan, tapir, tarsier, tiger, toad, turkey, turtle, walrus, wasp, water buffalo, weasel, whale, wolf, wombat, worm, yak, zebra, and any other animal, insect, or figure known in the art.

The invention also comprises a method of bathing comprising the steps of inserting a bar of soap into a fabric toy comprising an external mesh pocket, fastening the mesh pocket to prevent the soap from escaping the pocket, exposing the soap to water, and forming a lather with the soap for the purpose of cleaning a skin surface. In another embodiment a sponge is additionally inserted into a hollow inner sponge-holding cavity of the toy followed by fastening the inner cavity to prevent the sponge from escaping the inner cavity.

The fabric is made of a material selected from the group consisting of cloth, leather, suede, plush, fustian, velvet, mohair, worsted yarn, silk, cotton, polyester, terry cloth, lycra, neoprene, fleece, and combinations thereof.

The toy is configured in some embodiments to resemble an animal. This may comprise a body member substantially formed by an outer sheath, a head member attached to the body member, and at least one limb attached to the body member.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Soap and Sponge Holding Toy

Figure 1:
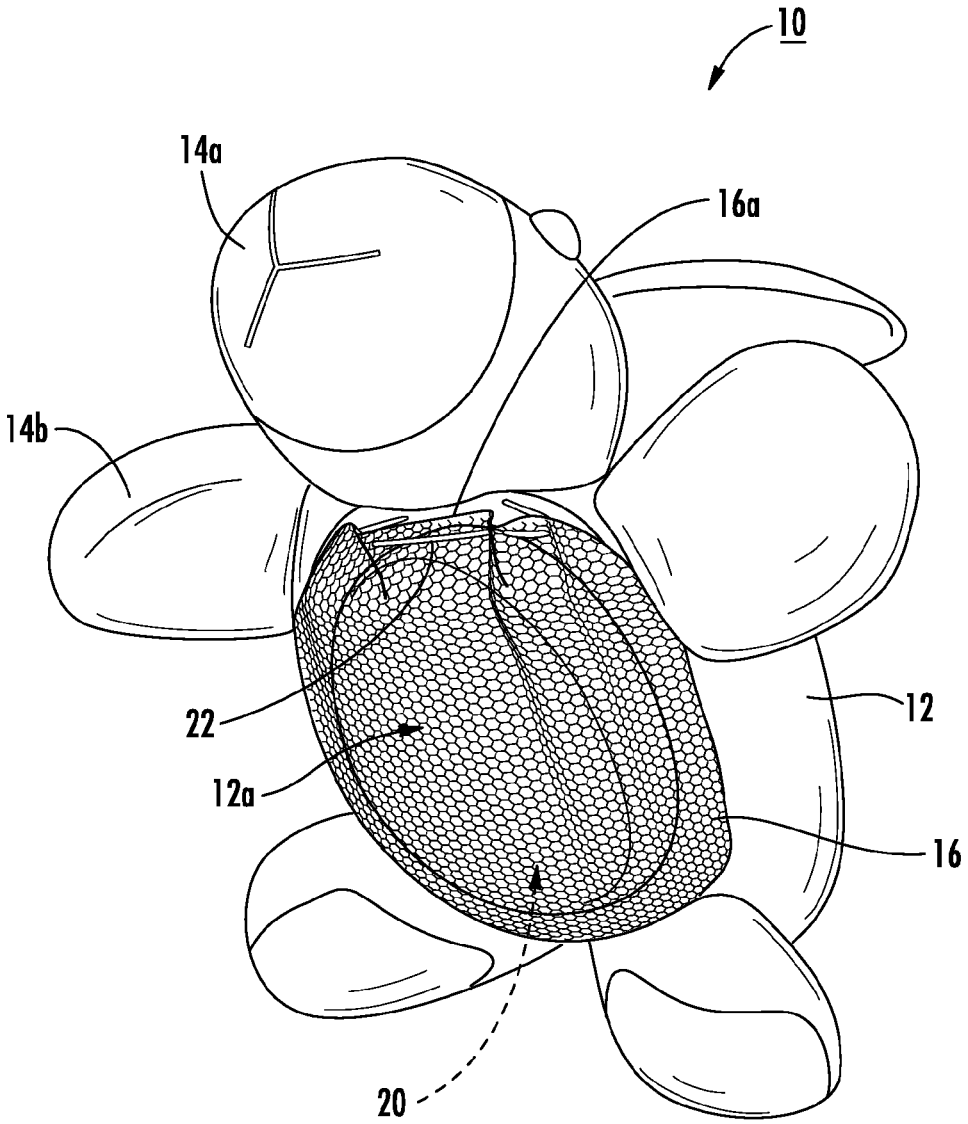
FIG. 1 is a front perspective view illustrating one embodiment the invention.

Referring initially to FIG. 1, one embodiment of the invention is illustrated. The bath toy 10 comprises an outer sheath 12 made from a soft textile. The outer sheath is substantially hollow, having a first side 12*a* and a second side 12*b* (FIG. 2) with the hollow inner cavity substantially defined by the first side 12*a* and second side 12b. The material is selected from the group consisting of cloth, leather, suede, plush, bamboo, fustian, velvet, mohair, worsted yarn, silk, cotton, polyester, terry cloth, Lycra, neoprene, fleece, and combinations thereof. In a preferred embodiment the textile(s) is/are fabric capable of holding enough water to foster the creation of soap lather, yet dry rapidly.

The outer sheath 12 is made from at least one textile panel. In one embodiment, a plurality of textile panels are attached to each other by means well known in the art. In a preferred embodiment, the textile panels are sewn together. The sizes and shapes and orientation of the panels substantially define the shape of outer sheath 12 and also the toy 10. In a preferred embodiment, the outer sheath is configured to resemble an animal. Additional body member segments are formed from textile panels that are attached to the outer sheath 12 to further define the animal resemblance. In one embodiment, the outer sheath 12 defines the main body of the animal. A head member 14*a* is formed from textile panels, and is attached to the outer sheath 12. In some embodiments, at least one limb member 14*b* is formed from textile panels, and is attached to the outer sheath 12. Other projections such as ears, tails, noses, antennae, horns, wings, probosci, trunks, scales, pouches, beaks, fins, gills, mains, tentacles, stingers, tusks, humps, hooves, talons, and any other feature known in the art are also utilized in some embodiments.

The animal that the toy 10 resembles one of an aardvark, alligator, American bison, buffalo, ant, anteater, antelope, ape, armadillo, ass/donkey, baboon, badger, barracuda, bat, bear, beaver, bee, bison, boar, buffalo, bunny, bush baby, butterfly, camel, caribou, cat, caterpillar, chamois, cheetah, chicken, chimpanzee, chinchilla, cobra, cockroach, cormorant, cow, coyote, crab, crane, crocodile, crow, deer, dog, dogfish, dolphin, donkey, dove, dragonfly, duck, dugong, eagle, echidna, eel, eland, elephant, elephant seal, elk, falcon, ferret, finch, fly, fox, frog, gaur, gazelle, gerbil, giant panda, giraffe, gnu, goat, goose, gorilla, silverback, guanaco guinea fowl, guinea pig, gull, hamster, hare, hawk, hedgehog, heron, hippopotamus, hornet, horse, human, hyena, iguana, jackal, jaguar, jellyfish, kangaroo, koala, komodo dragon, kouprey, kudu, lark, lemur, leopard, lion, llama, lobster, locust, loris, louse, lyrebird, magpie, mallard, manatee, meerkat, mink, mole, monkey, moose, mouse, mosquito, mule, narwhal, newt, nightingale, okapi, oryx, ostrich, otter, owl, ox, oyster, panther, partridge, peafowl, pelican, penguin, pig, pigeon, platypus, pony, porcupine, quelea, rabbit, raccoon, rail, ram, rat, raven, red deer, red panda, reindeer, rhinoceros, salamander, sea lion, seahorse, seal, seastar, shark, sheep, shrew, skunk, snail, snake, spider, squid, squirrel, stinkbug, swan, tapir, tarsier, tiger, toad, turkey, turtle, walrus, wasp, water buffalo, weasel, whale, wolf, wombat, worm, yak, and zebra.

Figure 3:
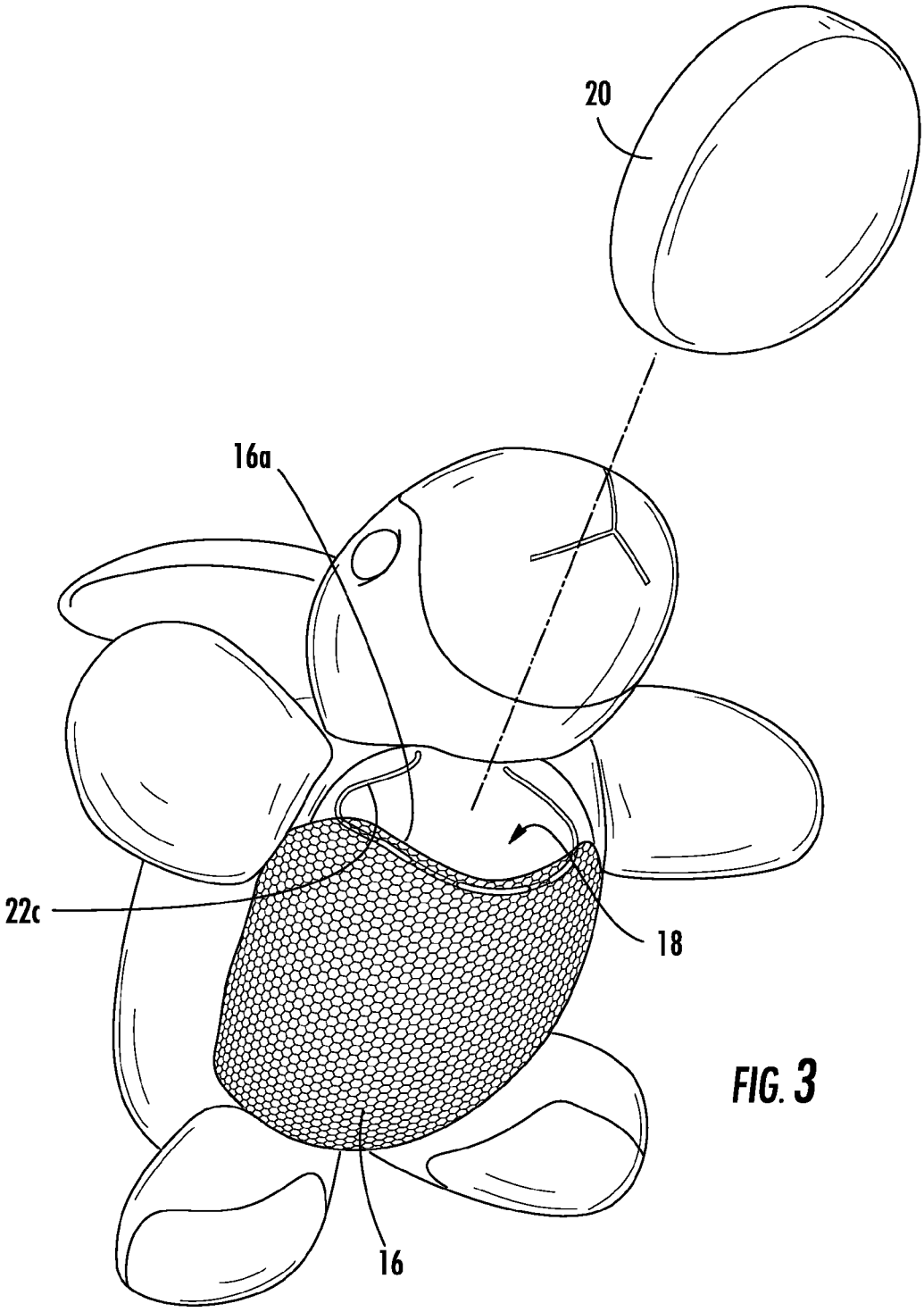
FIG. 3 is a partially exploded front perspective view illustrating one embodiment the invention.
Figure 4:
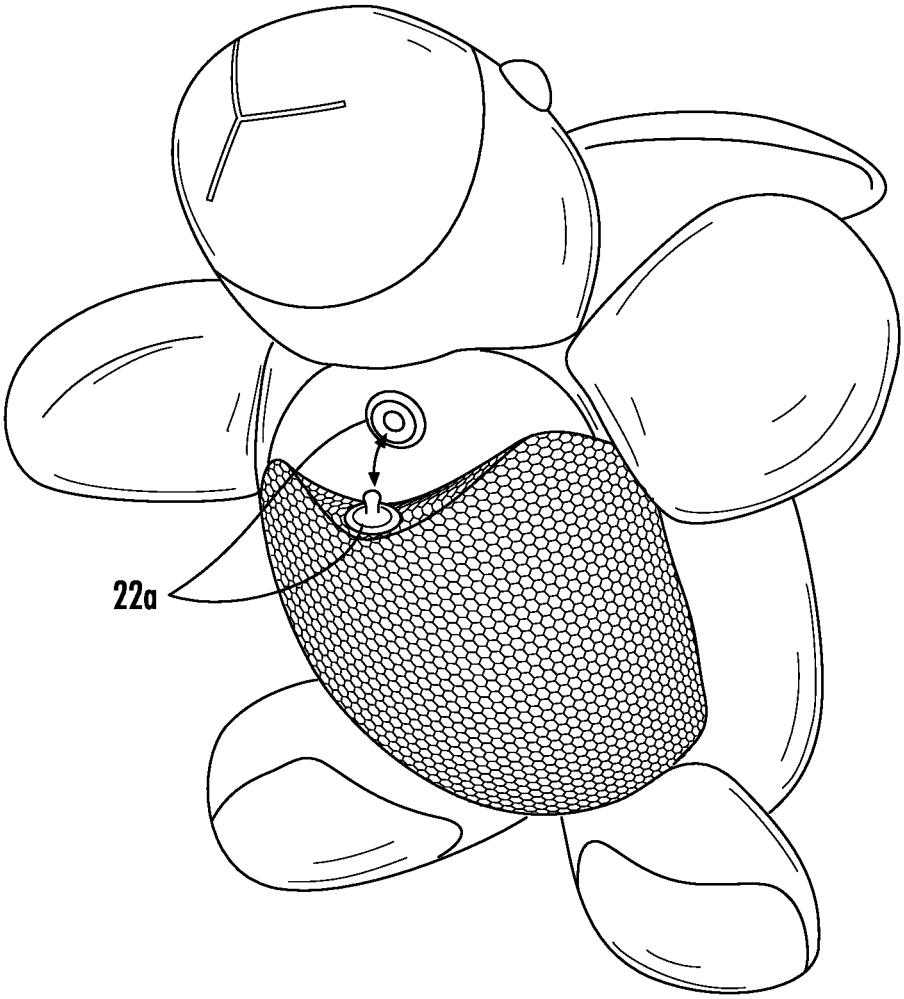
FIG. 4 is a front perspective view illustrating one embodiment the invention.
Figure 5:
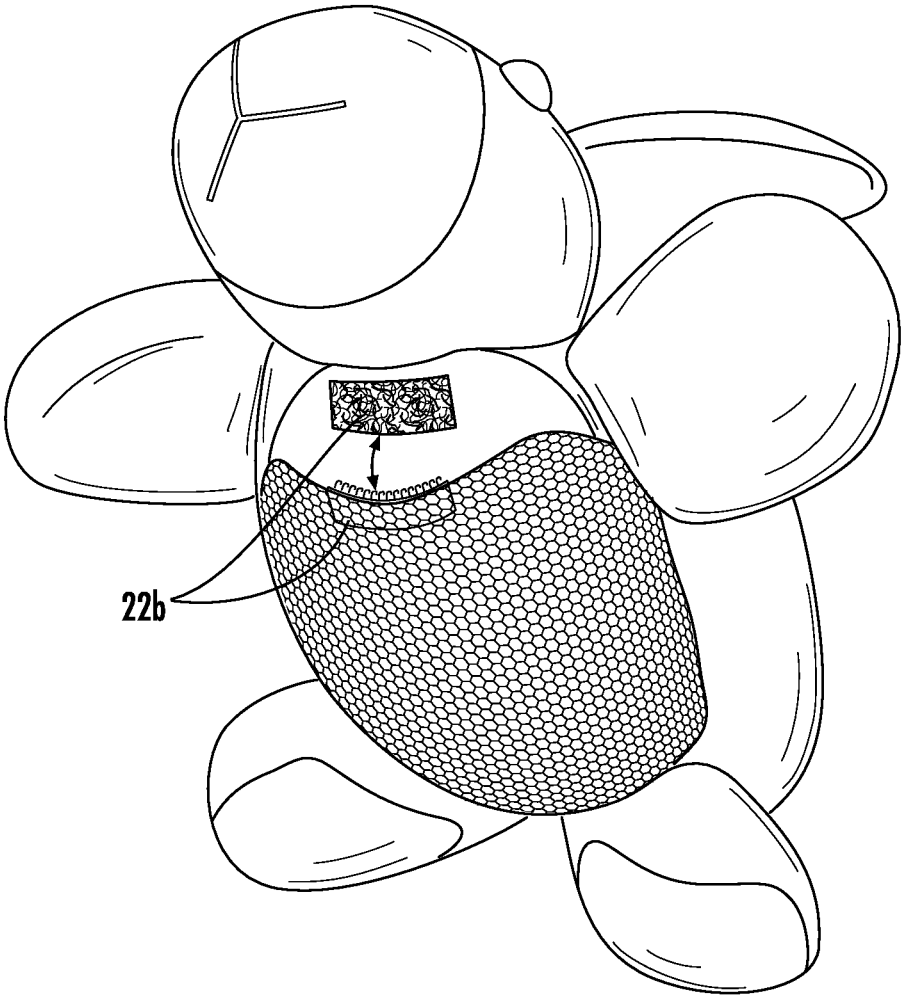
FIG. 5 is a front perspective view illustrating one embodiment the invention.

FIG. 3 illustrates that the toy 10 comprises a first mesh panel 16 attached, preferably sewn, to the first side 12*a* of the outer sheath 12. The mesh panel 16 comprises a non-attached edge 16*a*, creating a first opening so that the mesh panel forms a first pocket 18 of a size and dimension suitable for holding a bar of soap 20. A first fastener 22 closes the first opening to secure the soap 20. The first fastener is at least one of a snap 22*a* (FIG. 4), hook & loop fastener 22*b* (FIG. 5), button, zipper, buckle, hook & eye, and any other fastening means known in the art.

Figure 6:
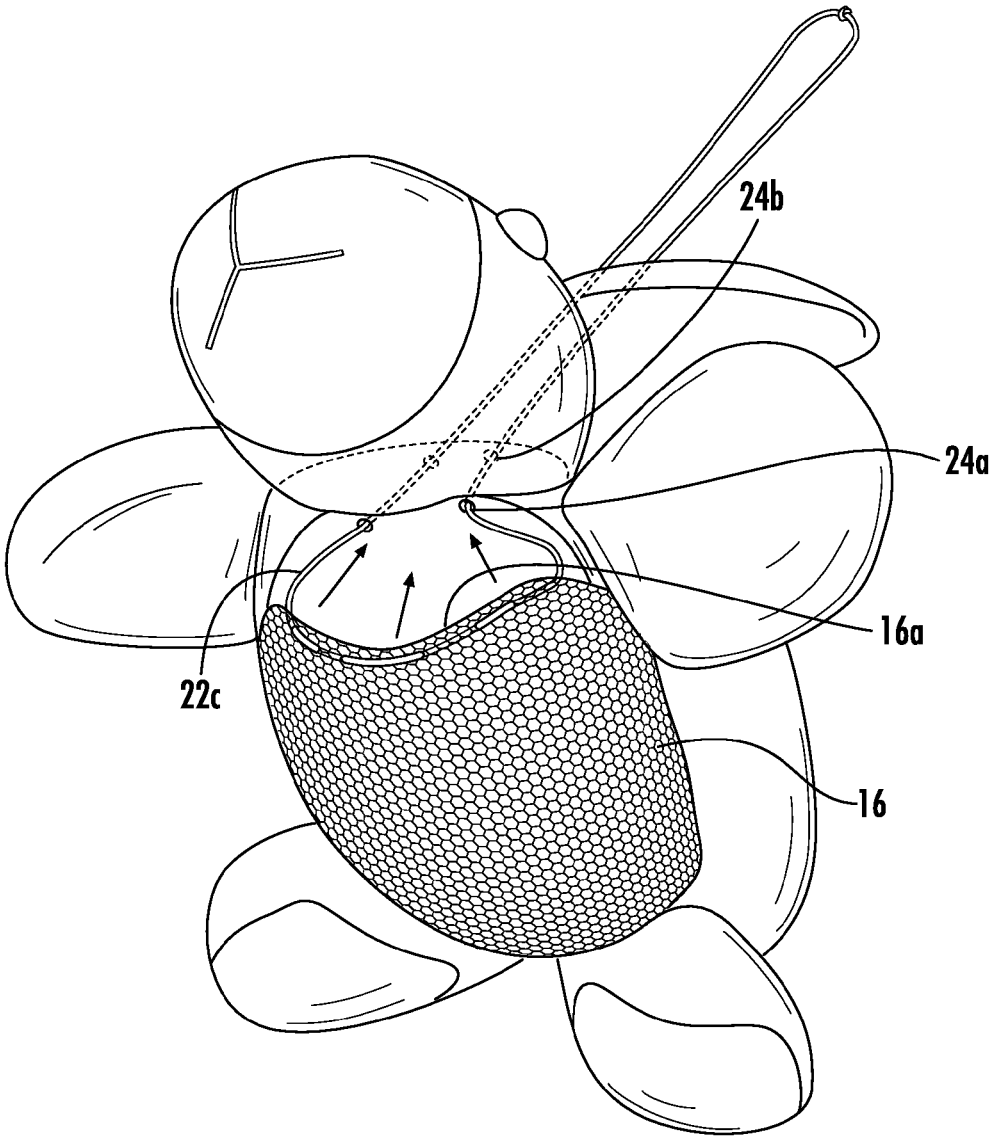
FIG. 6 is a front perspective view illustrating one embodiment the invention.

In one embodiment illustrated by FIG. 6, the first fastener 22 is a drawstring 22*c*. The drawstring 22*c* is a flexible line that is attached to the first mesh panel 16 proximate the non-attached edge 16*a* of the first mesh panel 16. In a preferred embodiment, the drawstring 22*c* is threaded through the mesh panel 16 proximate the non-attached edge 16*a*. At least one first hole 24*a* is on the first side 12*a* of the outer sheath 12 that allows the drawstring 22*c* to pass through the first hole 22*c*. At least one second hole 24*b* is on the second side 12*b* of the outer sheath 12 that allows the drawstring 22*c* to pass through the second hole 24*b*. The drawstring 22*c* is attached to the non-attached edge 16*a* of the mesh panel 16 and projects through the first hole 24*a* and then through the second hole 24*b*, projecting outwardly from the second side 12*b* of the toy. Pulling the drawstring 22*c* outwards from the second side 12*b* of the toy causes the first pocket 18 to substantially close by being pulled inward towards the first side 12*a* of the outer sheath 12. If a bar of soap 20 is in the pocket 18, pulling the drawstring 22*c* outwards from the second side 12*b* of the toy secures the soap 20 in the pocket 18.

Figure 7:
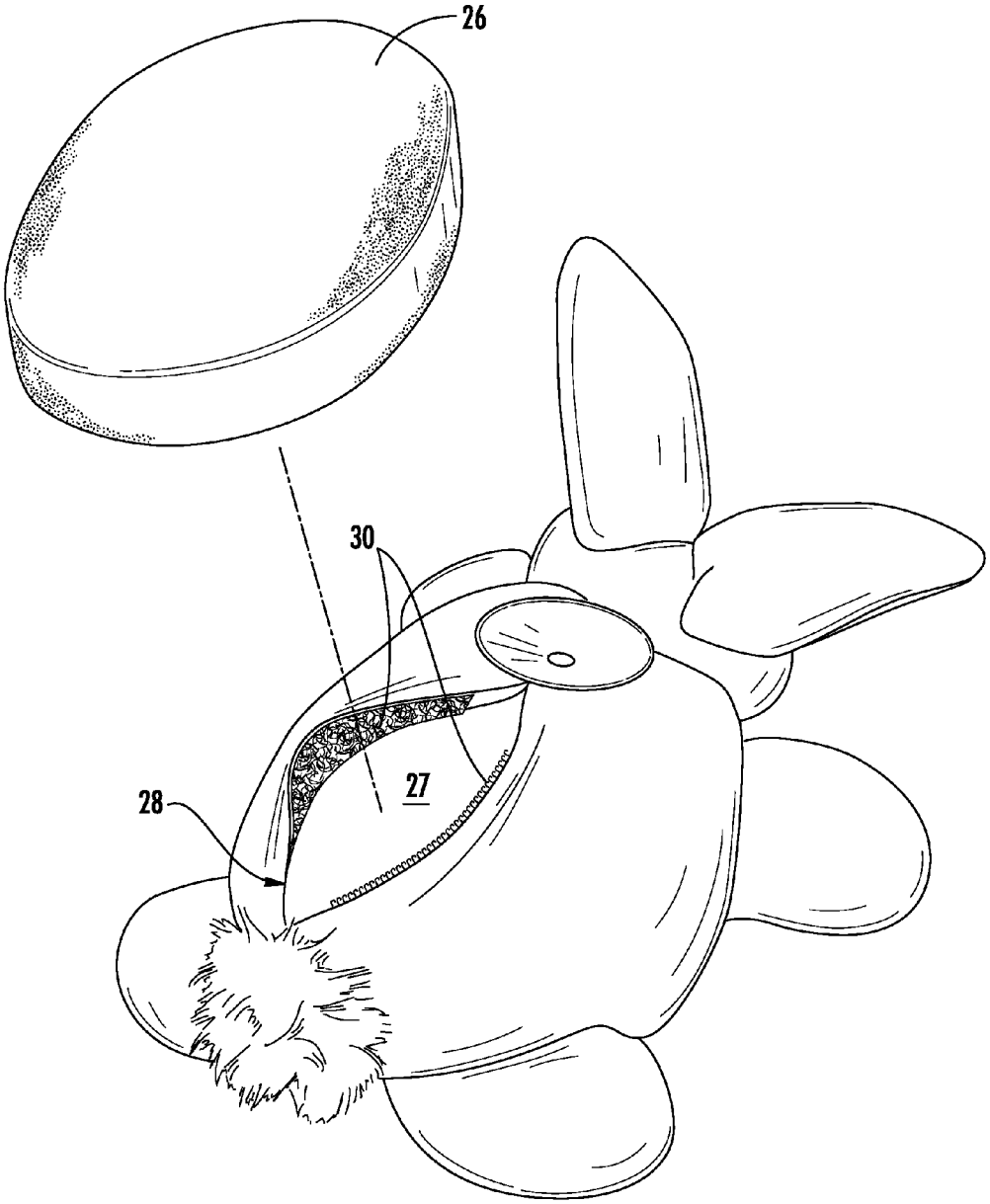
FIG. 7 is a partially exploded rear perspective view illustrating one embodiment the invention.
Figure 8:
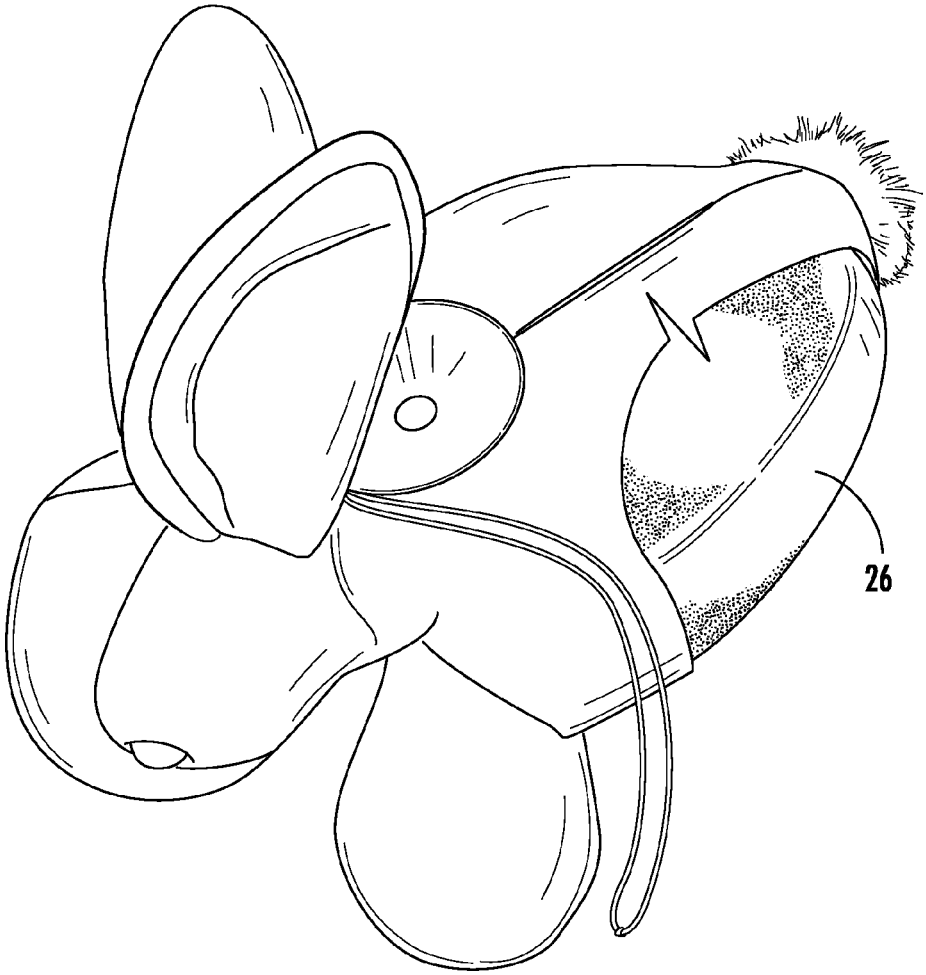
FIG. 8 is a rear perspective cutaway view illustrating one embodiment the invention.

FIG. 7 illustrates one embodiment of the toy 10 wherein a sponge 26 is inserted through a second opening 28 on the second side 12*b* of the outer sheath 12 so that the sponge 26 may be encased in a compartment 27 of a suitable size and dimension to hold the sponge 26. The compartment 27 is substantially defined by the outer sheath 12. A second fastener 30 closes the second opening 28 to securely capture the sponge within the compartment 27. The second fastener 30 is at least one of a snap, hook & loop fastener, button, zipper, buckle, hook & eve, drawstring, and any other fastening means known in the art. FIG. 8 illustrates the toy 10 having a sponge 26 secured within the compartment 27 and the second fastener 30 in a substantially closed state.

Figure 2:
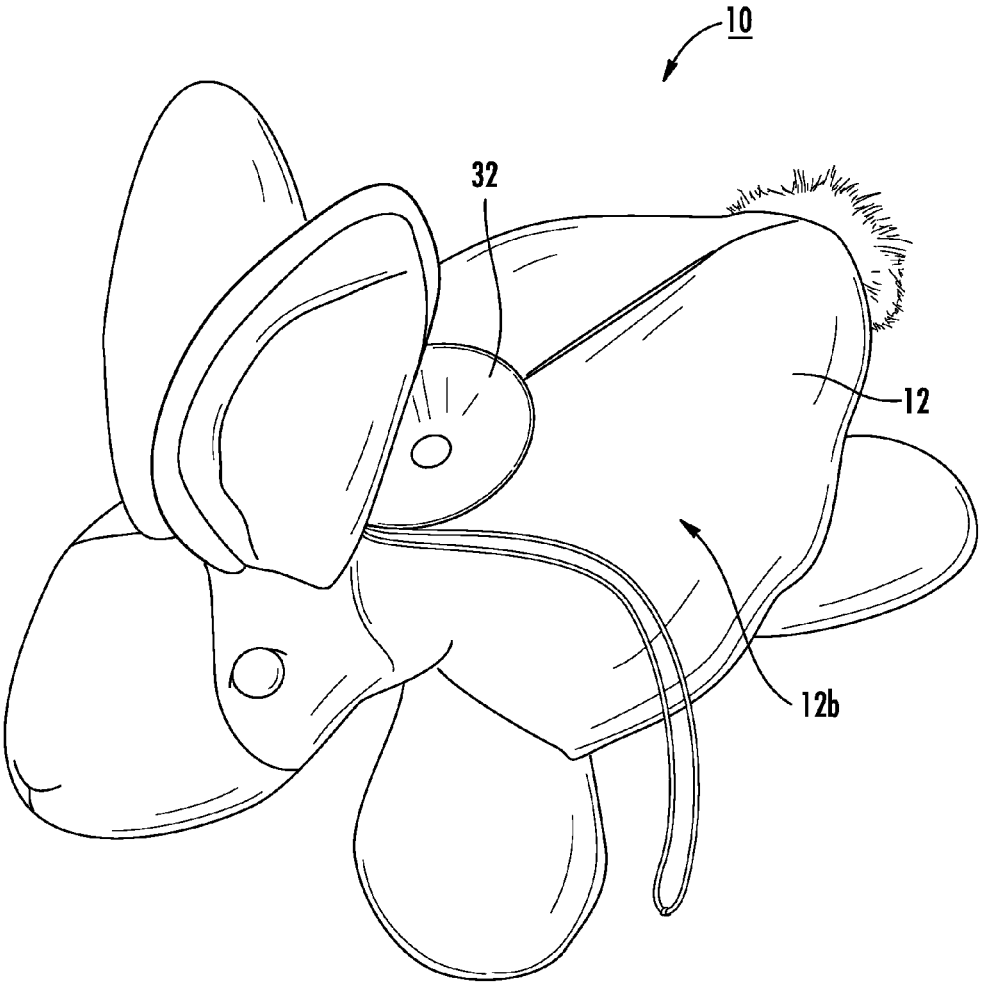
FIG. 2 is a rear perspective view illustrating one embodiment the invention.
Figure 9:
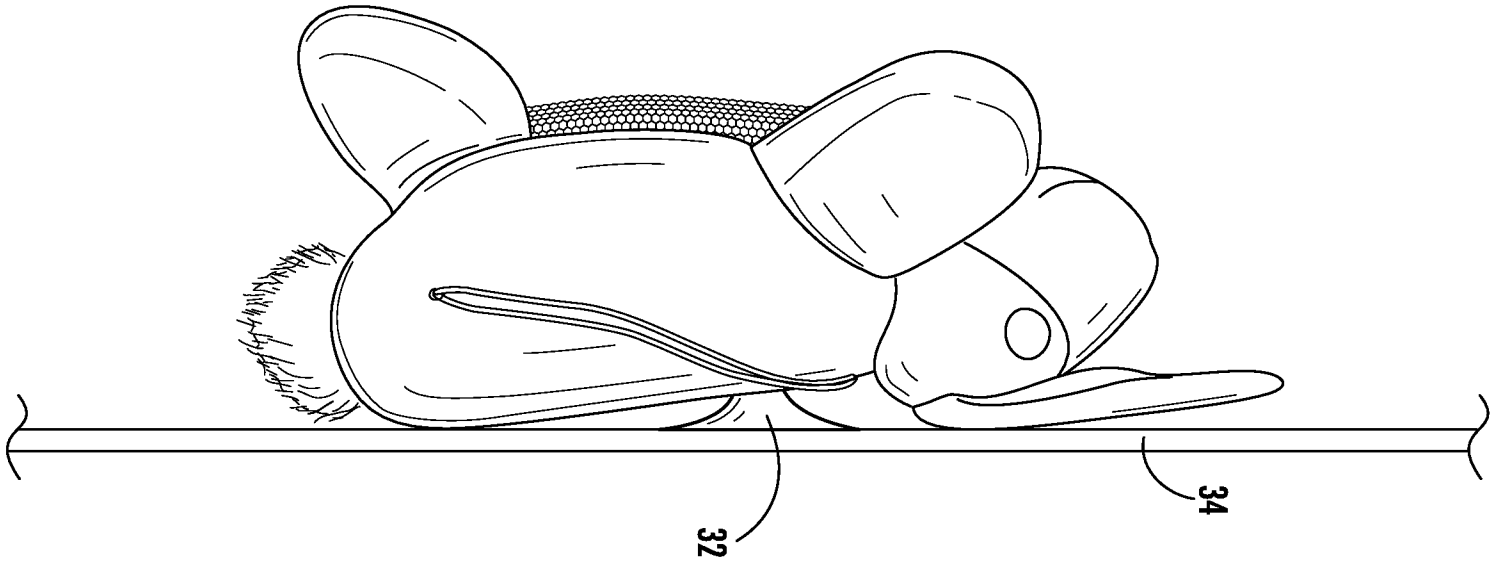
FIG. 9 is a side view illustrating one embodiment the invention interacting with a vertical surface.

FIG. 2 illustrates the toy 10 having a suction cup 32 attached to the outer sheath 12 of the toy 10. The suction cup 32 is a flexible disc having a curvature so that when the center of the suction cup 32 is pressed against a substantially non-porous surface 34 (FIG. 9), the suction cup 32 flattens and creates a pressure differential between a low pressure cavity formed between the suction cup 32 and the surface 34 and the external pressure of the atmosphere. This promotes adherence of the suction cup 32 to the surface 34. The non-suctioning side of the suction cup 32 is attached to the outer sheath 12 of the toy 10 so that the suction cup 32 is positioned to be capable of engaging a suctionable surface. This allows the toy 10 to be hung on vertical bathroom surfaces by the suction cup to promote drying of the toy 10 between uses.

Method for Using the Soap and Sponge Holding Toy

A method of using the toy 10 for lathering comprises inserting a bar of soap 20 into a mesh pocket 16 of the toy. The mesh pocket 16 is fastened close using a first fastener 22 on the mesh pocket. The first fastener is at least one of a snap 22*a*, hook & loop fastener 22*b*, button, zipper, buckle, hook & eye, drawstring, and any other fastening means known in the art.

In one embodiment, a sponge 26 is inserted into a hollow inner cavity 27 of a suitable size and dimension to hold the sponge 26. Then the hollow inner cavity is fastened with a second fastener 30 to substantially shut to encase the sponge 26. The second fastener is at least one of a snap, hook & loop fastener, button, zipper, buckle, hook & eye, drawstring, and any other fastening means known in the art.

The toy 10 is exposed to water, and lather is made with the soap 20 due to agitating the wet toy 10 and soap 20, preferably on a bather's skin. The lather seeps through the mesh pocket 16 holding the soap 20, so that an individual bathing with the toy 10 is exposed to soap lather. Water captured by the sponge 26 contributes to the water needed to lather the soap 20. A person using the toy 10 is exposed to soap lather for bathing purposes. The toy 10 is hung on a vertical surface 34 using a suction cup 32 attached to the toy. This promotes draining of the toy 10 and more rapid drying.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A bath toy comprising:

a textile outer sheath having a first side, a second side, and a hollow inner cavity between the first side and the second side, the textile outer sheath formed to substantially define a shape of the toy;

a first mesh panel attached to the first side of the outer sheath having a non-attached edge that defines a first opening thereby forming a first pocket a bar of soap carried within the first pocket;

a first fastener operable to close the first opening of the first pocket and secure the bar of soap within the first pocket;

a sponge carried within the hollow inner cavity; and a second opening on the second side of the outer sheath operable to provide access to the hollow inner cavity;

wherein the first fastener comprises a drawstring having a first end, a second end, and a middle portion between the first and second ends, wherein the drawstring is-attached to the first mesh panel so that the middle portion of the drawstring is proximate the non-attached edge, and at least one first hole in the first side of the outer sheath accommodates passage by the first and seconds ends of the drawstring through the first hole, and wherein at least one second hole in the second side of the outer sheath accommodates passage by the first and seconds ends of the drawstring through the second hole so that that the drawstring may be tightened, thereby drawing the first pocket against the first side of the outer sheath.

2. The invention of claim 1, further comprising:

a second fastener operable to close the second opening of the outer sheath for the purpose of securing the sponge within the hollow inner cavity.

3. The invention of claim 2, wherein the second fastener is at least one of a snap, hook & loop fastener, drawstring, button, zipper, buckle, and hook & eye fastener.

4. The invention of claim 1, further comprising a suction cup having a suction side and a mounting side, wherein the suction cup is attached by the mounting side to the second side of the outer sheath so the suction side faces outwards from the outer sheath to allow the toy to be suctionably held to a surface capable of engaging a suction cup.

5. The invention of claim 1, wherein the textile is selected from the group consisting of cloth, leather, suede, plush, fustian, velvet, mohair, worsted yarn, silk, cotton, polyester, terry cloth, lycra, neoprene, fleece, and combinations thereof.

6. The invention claim 1, wherein the outer sheath is configured to resemble an animal.

7. The invention of claim 6, further comprising:

a main body member substantially formed by the outer sheath;

a head member attached to the body member; and at least one limb attached to the body member.

8. The invention of claim 6, wherein the animal is chosen from the group consisting of an aardvark, alligator, American bison, buffalo, ant, anteater, antelope, ape, armadillo, ass/donkey, baboon, badger, barracuda, bat, bear, beaver, bee, bison, boar, buffalo, bunny, bush baby, butterfly, camel, caribou, cat, caterpillar, chamois, cheetah, chicken, chimpanzee, chinchilla, cobra, cockroach, cormorant, cow, coyote, crab, crane, crocodile, crow, deer, dog, dogfish, dolphin, donkey, dove, dragonfly, duck, dugong, eagle, echidna, eel, eland, elephant, elephant seal, elk, falcon, ferret, finch, fish, fly, fox, frog, gaur, gazelle, gerbil, giant panda, giraffe, gnu, goat, goose, gorilla, silverback, guanaco guinea fowl, guinea pig, gull, hamster, hare, hawk, hedgehog, heron, hippopotamus, hornet, horse, human, hyena, iguana, jackal, jaguar, jellyfish, kangaroo, koala, komodo dragon, kouprey, kudu, lark, lemur, leopard, lion, llama, lobster, locust, loris, louse, lyrebird, magpie, mallard, manatee, meerkat, mink, mole, monkey, moose, mouse, mosquito, mule, narwhal, newt, nightingale, okapi, oryx, ostrich, otter, owl, ox, oyster, panther, partridge, peafowl, pelican, penguin, pig, pigeon, platypus, pony, porcupine, quelea, rabbit, raccoon, rail, ram, rat, raven, red deer, red panda, reindeer, rhinoceros, salamander, sea lion, seahorse, seal, seastar, shark, sheep, shrew, skunk, snail, snake, spider, squid, squirrel, stinkbug, swan, tapir, tarsier, tiger, toad, turkey, turtle, walrus, wasp, water buffalo, weasel, whale, wolf, wombat, worm, yak, and zebra.

* * * * *